US007018690B2

(12) United States Patent
Lee

(10) Patent No.: US 7,018,690 B2
(45) Date of Patent: Mar. 28, 2006

(54) MULTIPURPOSE FANCY GOODS

(75) Inventor: So Young Lee, Nonsan (KR)

(73) Assignee: Seung-Hoon LEE, Nosan (KR)

( * ) Notice: Subject to any disclaimer, the term of this patent is extended or adjusted under 35 U.S.C. 154(b) by 77 days.

(21) Appl. No.: 10/716,481

(22) Filed: Nov. 20, 2003

(65) Prior Publication Data

US 2004/0166292 A1 Aug. 26, 2004

(30) Foreign Application Priority Data

Nov. 25, 2002 (KR) ..... 10-2002-35101

(51) Int. Cl.
*B32B 1/02* (2006.01)
*B32B 3/10* (2006.01)

(52) U.S. Cl. ..... 428/36.5; 428/57; 428/131; 362/154; 362/806

(58) Field of Classification Search ..... 428/36.5, 428/57, 131, 137, 192; 362/154, 806; 446/488; 229/115

See application file for complete search history.

(56) References Cited

U.S. PATENT DOCUMENTS 3,666,607 A * 5/1972 Weissman ..... 428/33

* cited by examiner

*Primary Examiner*—Alexander S. Thomas
(74) *Attorney, Agent, or Firm*—Troxell Law Office, PLLC

(57) ABSTRACT

Multipurpose fancy goods having a plurality of sheets connected to each other to form a polyhedron. The multipurpose fancy goods including a first regular square-shaped sheet, a second regular square-shaped sheet, a first regular triangle-shaped sheet, and a second regular triangle-shaped sheet each being made of a polypropylene foam sheet. Each of the first and second regular square-shaped sheets has four regular square-shaped sheet coupling parts each protruded outwardly from one side of each edge. Each of the first and second regular square-shaped sheets has four regular square-shaped sheet coupling through holes each formed around each corner. Each of the first and second regular triangle-shaped sheets has three regular triangle-shaped sheet coupling through holes each formed around each corner.

2 Claims, 7 Drawing Sheets

MULTIPURPOSE FANCY GOODS

BACKGROUND OF THE INVENTION

1. Field of the Invention

The present invention relates to multipurpose fancy goods, and more particularly, to multipurpose fancy goods that can be assembled in the shape of a rectangular cuboid such as a lighting case, a box, and a puzzle game box by use of a plurality of regular triangle/square-shaped sheets.

2. Background of the Related Art

In general, sectional boxes or goods for puzzle games are made by utilization of triangular or square faces.

Specifically, boxes or cases are instruments that are used necessarily for storing things in a practical life. For example, they are used for moving the things kept therein to another place, for organizing various kinds of things at home, for storing products in industrial or agricultural places, or for other various purposes. With a remarkable improvement of life environments, furthermore, the definite necessities for them are being increased.

Generally, conventional sectional boxes have been devised in just order to store things thereinto, but as their materials are developed, they have been used for various purposes. As one example of the prior arts, Korean Utility Model Publication No. 1998-015680 discloses a fancy instrument using a helmet where an installing plate is mounted on the lower portion of a helmet body, the installing plate having a socket for a bulb and a button-mounted touch type of a power switch thereon.

As another example of the prior arts, Korean Utility Model Registration No. 20-272046 discloses a lighting case for decoration that has several covers variable depending upon the atmosphere around.

As other examples of the prior arts, Korean Utility Model Registration No. 20-0244329 discloses a cubic type of flat puzzle, and Korean Patent laid-open Publication No. 2001-0092563 discloses a polygonal cubic puzzle using an isosceles triangular prism.

As another example of the prior arts, Korean Utility Model Registration No. 20-0261423 discloses a box that is assembled with a sheet having an eight face composed of four hexagonal faces and four regular triangular faces, thereby forming a cube.

As another example of the prior arts, Korean Utility Model laid-open Publication No. 99-11163 discloses a folding box that has a support side plate connected to a bottom plate for providing a side plate to the other side, the support side plate having a double configuration to be folded, a fixing protrusion formed at one end of the support side plate, and a fixing protrusion insertion groove formed at one side of the bottom plate for fitting the fixing protrusion thereto, such that the support side plate is just fixed to the bottom plate, without any use of a coupling member with the bottom plate.

The aforementioned prior arts have suggested the boxes for storing things therein, in which they have different coupling constructions, which make the assembling process rather complicated. For example, it is not easy to re-use a box in which light things like clothes, fruits, or cakes are put, after removing the things from the box. On the other hand, when a user feels that the box does not match the things to be put thereinto, he or she usually regards it as waste. In addition, because it is so bulky, it is not easy to move from one place to another place and also, the production cost becomes increased. Because the conventional boxes are just of prefabricated type, they are not used actually.

SUMMARY OF THE INVENTION

Accordingly, the present invention has been made to solve the above problems, and it is an object of the present invention is to provide multipurpose fancy goods which can be employed as a lighting case into which lighting is inserted using polypropylene sheets, which can be employed as a puzzle game formed of polypropylene sheets having various colors, and which can be employed as a sectional fancy box easily and simply constructed in a shape of a cuboid (i.e., rectangular parallelepiped) or an octahedron.

To achieve the above object, according to the present invention, there is provided multipurpose fancy goods having a plurality of sheets connected to each other to form a polyhedron, the multipurpose fancy goods comprising: a first regular square-shaped sheet, a second regular square-shaped sheet, a first regular triangle-shaped sheet, and a second regular triangle-shaped sheet each being made of a polypropylene foam sheet, wherein each of the first and second regular square-shaped sheets has four regular square-shaped sheet coupling parts each protruded outwardly from one side of each edge thereof in such a manner as not to be adjacent to the next one, and each of the first and second regular triangle-shaped sheets has three regular triangle-shaped sheet coupling parts each protruded outwardly from one side of each edge thereof in such a manner as not to be adjacent to the next one, and wherein each of the first and second regular square-shaped sheets has four regular square-shaped sheet coupling through holes each formed around each corner thereof, and each of the first and second regular triangle-shaped sheets has three regular triangle-shaped sheet coupling through holes each formed around each corner thereof, such that the respective four regular square-shaped sheet coupling parts of the first and second regular square-shaped sheets are inserted into four regular square-shaped sheet coupling holes for other regular square-shaped sheets adjacent to the upper and lower sides and the left and right sides thereof, and the respective three regular triangle-shaped sheet coupling parts of the first and second regular triangle-shaped sheet are inserted into three regular triangle-shaped sheets coupling holes for other regular triangle-shaped sheets adjacent to the upper and lower sides and the left and right sides thereof.

According to the multipurpose fancy goods of this invention, there are some advantages that the design work is simple, the assembling process is easy, and it is convenient to use. Furthermore, since they are made of a plastic material, they exhibit a higher strength than a sheet of paper, and thus, even when they are piled up, they can keep the things in the boxes safe or move them safely with the help of their good supporting forces. More particularly, the polypropylene foam sheet is easily folded along the dotted line (which is formed by the application of pressure thereto) and also it is easily to be unfolded upon disassembling.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1:
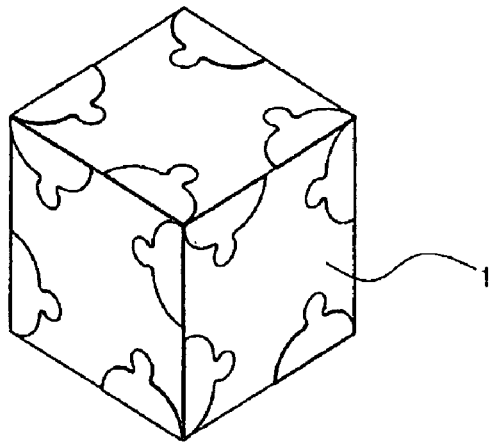
FIG. 1 is a perspective view of a box as the multipurpose fancy goods according to a first embodiment of the present invention.
Figure 2:
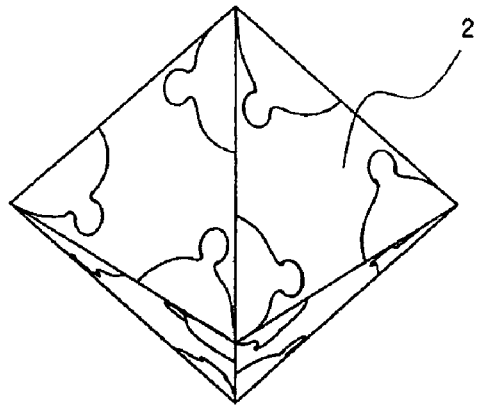
FIG. 2 is a perspective view of a box as the multipurpose fancy goods according to a second embodiment of the present invention.
Figure 3:
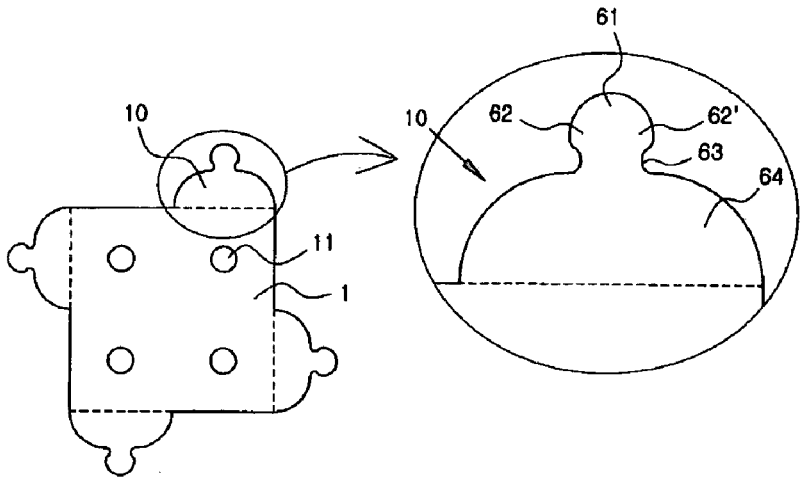
FIG. 3 is an extended view showing an example of a regular square-shaped sheet employed in the multipurpose fancy goods according to the first embodiment of the present invention.
Figure 4:
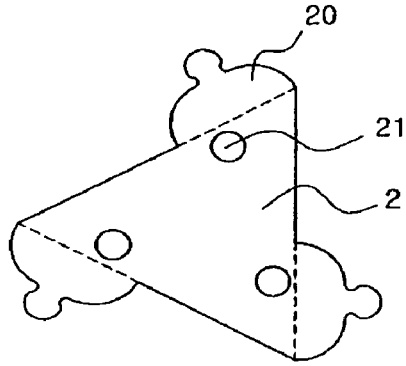
FIG. 4 is an extended view showing an example of a regular triangle-shaped sheet employed in the multipurpose fancy goods according to the second embodiment of the present invention.
Figure 5:
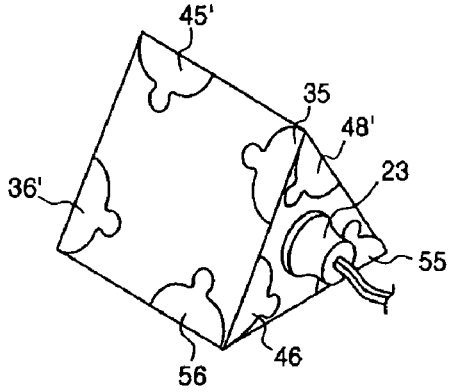
FIG. 5 is a perspective view of a sectional lighting case as the multipurpose fancy goods according to yet another embodiment of the present invention.
Figure 6:
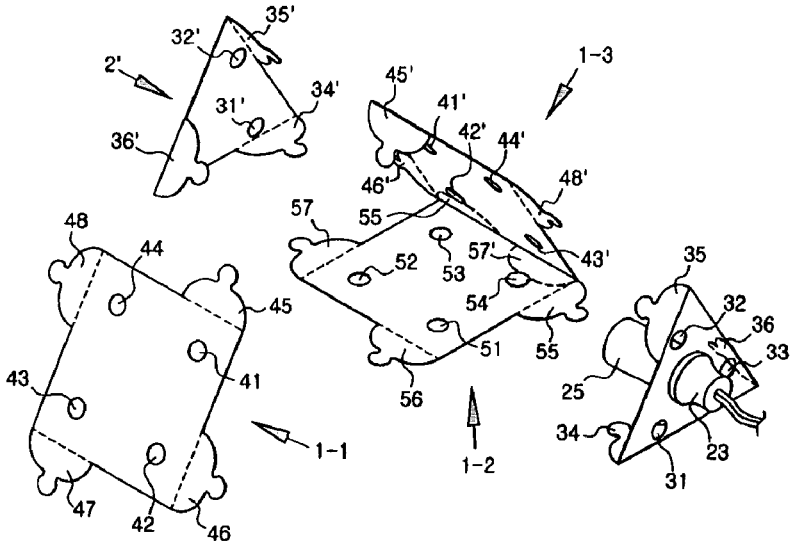
FIG. 6 is a detailed view of the assembly and disassembly of the sectional lighting case of FIG. 5.
Figure 7:
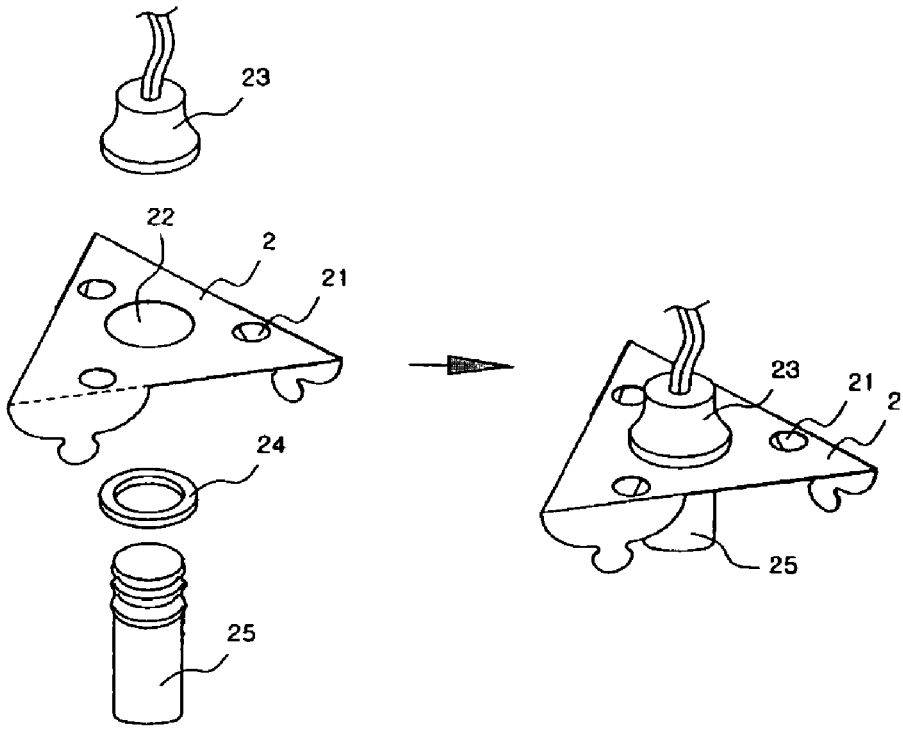
FIGS. 7 and 8 are views of the assembling process of the sectional lighting case of FIG. 5.
Figure 8:
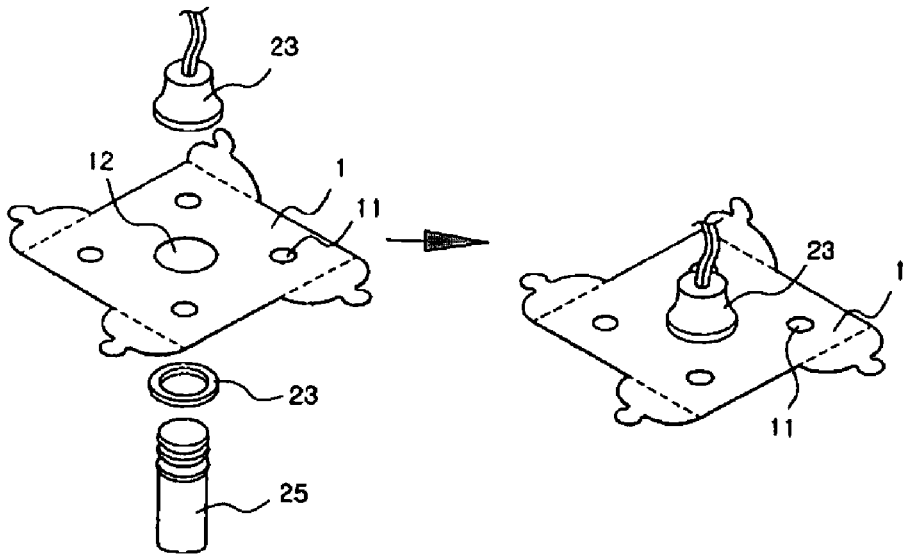
Figure 9:
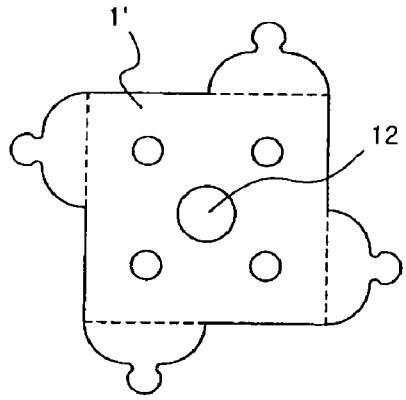
FIG. 9 is an extended view of another example of the regular square-shaped sheet employed in the multipurpose fancy goods of the first embodiment of the present invention.
Figure 10:
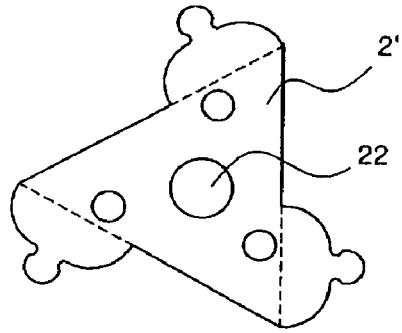
FIG. 10 is an extended view of another example of the regular triangle-shaped sheet employed in the multipurpose fancy goods of the second embodiment of the present invention.
Figure 11:
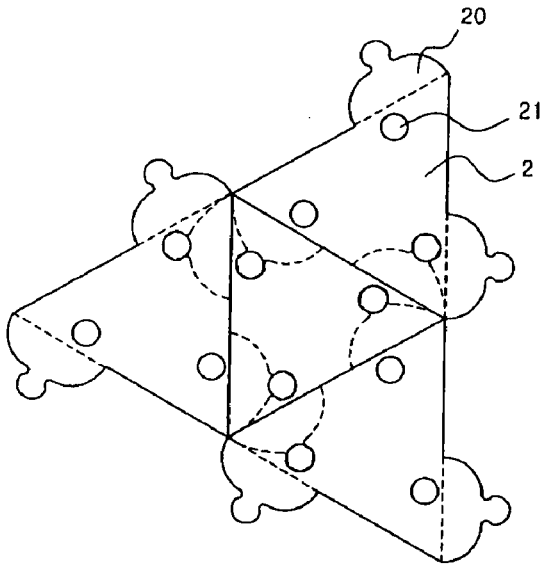
FIGS. 11 and 12 are views of the assembling states of the regular triangle-shaped sheets and the regular square-shaped sheets employed in the multipurpose fancy goods of the present invention.
Figure 12:
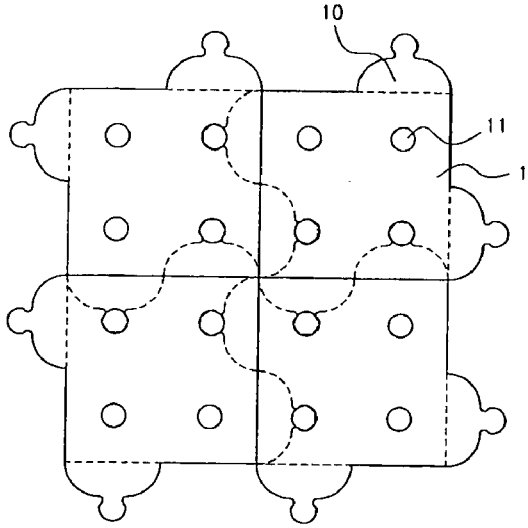
Figure 13:
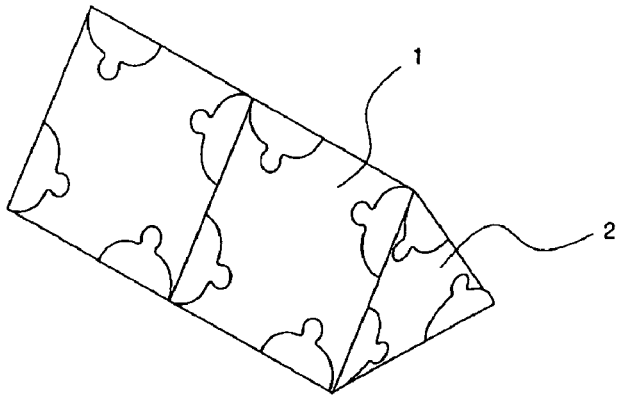
FIGS. 13 and 14 are views of another examples of the multipurpose fancy goods of the present invention.
Figure 14:
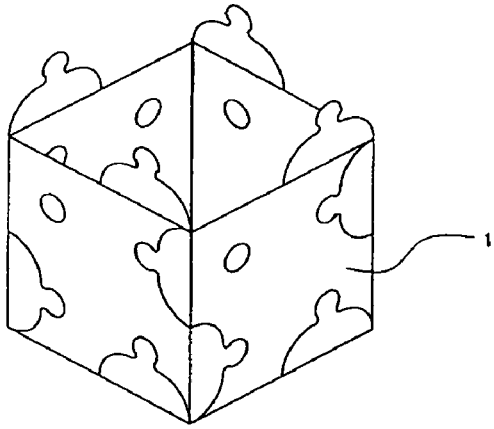
Figure 15:
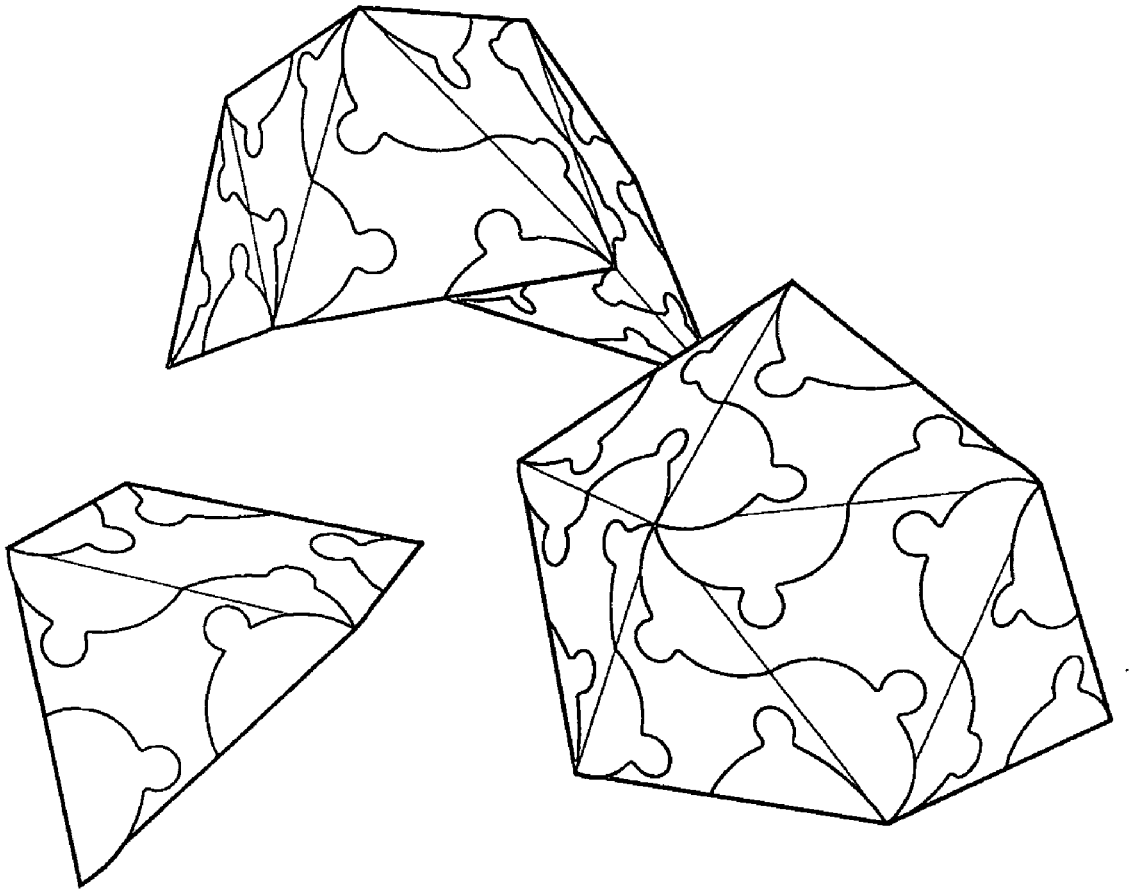
FIGS. 15 to 18 are photographs showing the examples of the multipurpose fancy goods of the present invention.
Figure 16:
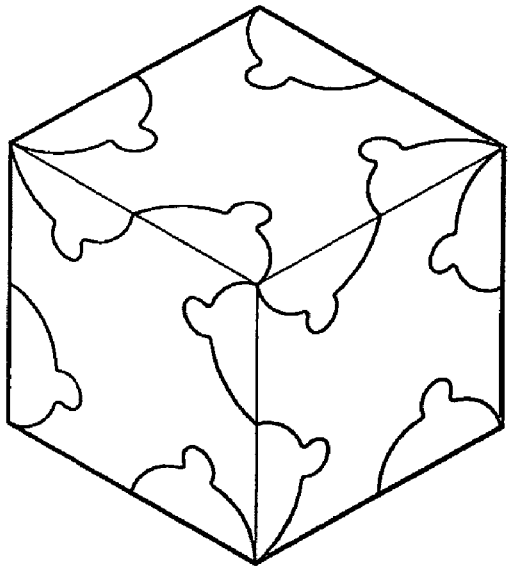
Figure 17:
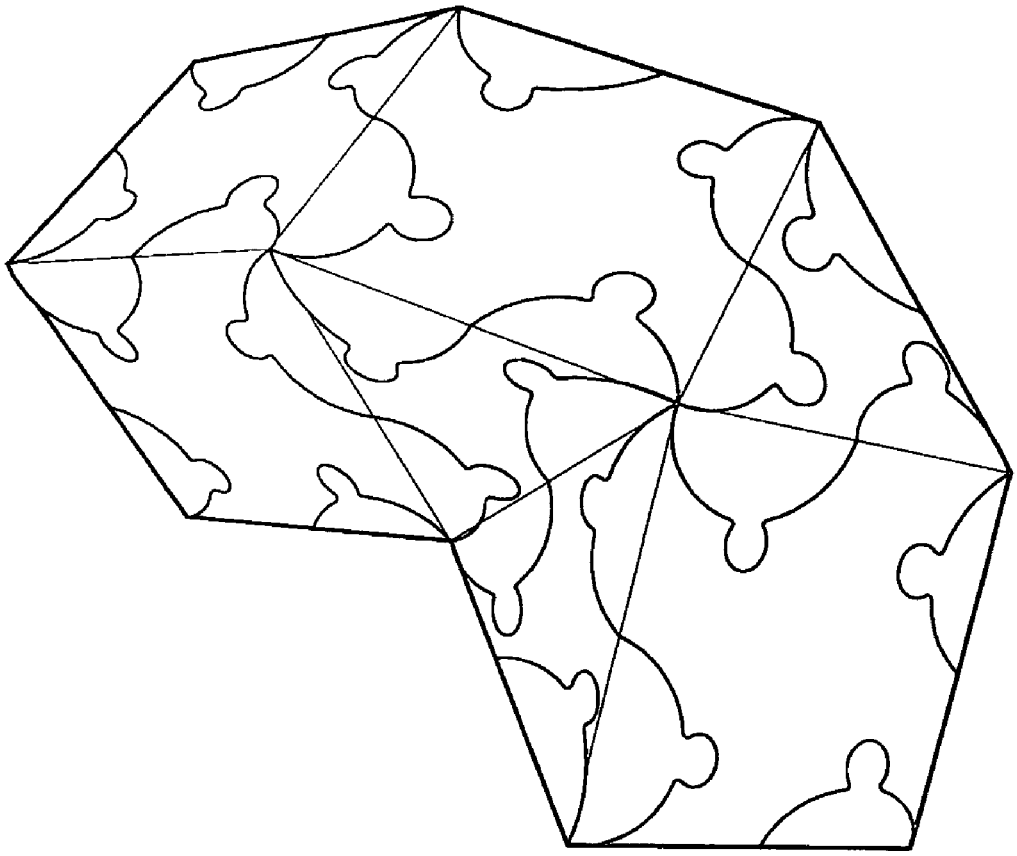
Figure 18:
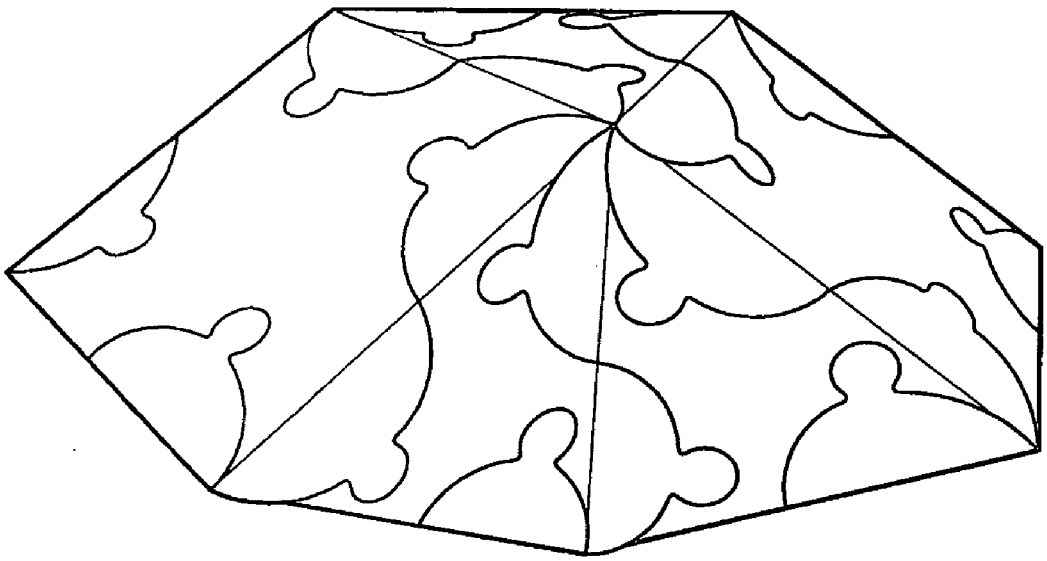

FIG. 1 is a perspective view of a box as the multipurpose fancy goods according to a first embodiment of the present invention, and FIG. 2 is a perspective view of a box as the multipurpose fancy goods according to a second embodiment of the present invention. FIG. 3 is an extended view showing an example of a regular square-shaped sheet employed in the multipurpose fancy goods according to the first embodiment of the present invention, and FIG. 4 is an extended view showing an example of a regular triangle-shaped sheet employed in the multipurpose fancy goods according to the second embodiment of the present invention. FIG. 5 is a perspective view of a sectional lighting case as the multipurpose fancy goods according to yet another embodiment of the present invention, FIG. 6 is a detailed view of the assembly and disassembly of the sectional lighting case of FIG. 5, and FIGS. 7 and 8 are views of the assembling process of the sectional lighting case of FIG. 5. FIG. 9 is an extended view of another example of, the regular square-shaped sheet employed in the multipurpose fancy goods of the first embodiment of the present invention, FIG. 10 is an extended view of another example of the regular triangle-shaped sheet employed in the multipurpose fancy goods of the second embodiment of the present invention, and FIGS. 11 and 12 are views of the assembling states of the regular triangle-shaped sheets and the regular square-shaped sheets employed in the multipurpose fancy goods of the present invention. FIGS. 13 and 14 are views of another examples of the multipurpose fancy goods of the present invention, and FIGS. 15 to 18 are photographs showing the examples of the multipurpose fancy goods of the present invention.

In the preferred embodiments of the present invention, reference numerals 1, 1', 1-1, 1-2 and 1-3 denote regular square-shaped sheets, reference numerals 2 and 2' denote regular triangle-shaped sheets, reference numerals 10, 45, 46, 47, 48, 45', 46', 47' and 48' denote regular square-shaped sheet coupling parts, reference numerals 11, 41, 42, 43, 44, 51, 52, 53, 54, 41', 42' and 43' and 44' denote regular square-shaped sheet coupling through holes, reference numerals 20, 34, 35, 36, 34', 35' and 36' denote regular triangular sheet coupling parts, reference numerals 21, 31, 32, 33, 31', 32' and 33' denote regular triangle-shaped sheet coupling through holes, a reference numeral 12 denotes a regular square-shaped sheet central through hole, 22 denotes a regular triangle-shaped sheet central through hole, 23 denotes a socket, 24 denotes a fixing member, 25 denotes electric lighting, 61 denotes a head part, 62 and 62' denote head side parts, 63 denotes a neck part, and 64 denotes a coupling body part 64.

As shown in FIG. 3, the sectional sheet according to a preferred embodiment of the present invention is formed of a substantially regular square-shaped sheet 1 being made of a polypropylene foam sheet, the regular square-shaped sheet 1 having four regular square-shaped sheet coupling parts 10 each protruded outwardly from one side of each edge thereof and four regular square-shaped sheet coupling through holes 11 each formed around each corner thereof.

Another regular square-shaped sheet 1' according to the present invention, as shown in FIG. 8, includes the four regular square-shaped sheet coupling parts 10 each protruded outwardly from one side of each edge thereof and the four regular square-shaped sheet coupling through holes 11 each formed around each corner thereof, a regular square-shaped sheet central through hole 12 formed in the middle thereof, a socket 23 and a fixing member 24 adapted to be inserted into the regular square-shaped sheet central through hole 12, and an lighting 25 adapted to be inserted fixedly into the socket 23 and the fixing member 24.

As shown in FIG. 4, on the other hand, another sectional sheet according to another preferred embodiment of the present invention is formed of a substantially regular triangle-shaped sheet 2 being made of a polypropylene foam sheet, the regular triangle-shaped sheet 2 having three regular triangle-shaped sheet coupling parts 20 each protruded outwardly from one side of each edge thereof and three regular triangle-shaped sheet coupling through holes 21 each formed around each corner thereof.

Another regular triangle-shaped sheet 2' according to the present invention, as shown in FIG. 7, includes the three regular triangle-shaped sheet coupling parts 20 each protruded outwardly from one side of each edge thereof and the three regular triangle-shaped sheet coupling through holes 21 each formed around each corner thereof, a regular triangle-shaped sheet central through hole 22 formed in the middle thereof, a socket 23 and a fixing member 24 adapted to be inserted into the regular triangle-shaped sheet central through hole 22, and an lighting 25 adapted to be inserted fixedly into the socket 23 and the fixing member 24.

With the, coupling between the regular square-shaped sheets 1 and 1', between the regular triangle-shaped sheets 2 and 2', or between the regular square-shaped sheet and the regular triangle-shaped sheet, the multipurpose fancy goods according to the present invention can achieve their various shapes and purposes.

As shown in FIG. 3, the four regular square-shaped sheet coupling parts 10 and the three regular triangle-shaped sheet coupling parts 20 are protruded from one side of the regular square-shaped sheet 1, each having a head part 61 with a top portion protruded in a round shape, head side parts 62 and 62' protruded outwardly in a relatively larger oval than a circle at both sides of the head part 61, a neck part 63 somewhat indented to the both sides of the head part 61, and a coupling body part 64 formed in an oval being extended to the left and right at the lower portion of the neck part 63.

The coupling is carried out in such a manner that the head part 61 of each of the regular square-shaped sheet coupling parts 10, 45, 46, 47, 48, 45', 46', 47' and 48' or the head part 61 of each of the regular triangle-shaped sheet coupling parts 20, 34, 35, 36, 34', 35' and 36' is inserted slidably into each of the regular square-shaped sheet coupling through holes 11, 41, 42, 43, 44, 51, 52, 53, 54, 41', 42' and 43' or each of the regular triangle-shaped sheet coupling through hole 21, 31, 32, 33, 31', 32' and 33'. At this time, the head side parts 62 and 62' enable the coupling relation between the coupling part and the coupling through hole to be substantially rigid.

In this case, the head part 61 has the same diameter as or a little smaller diameter than the regular square-shaped sheet coupling through hole 11. By the use of the head side parts 62 and 62', however, the head part 61 that has been inserted into the coupling through hole cannot slip from the coupling through hole.

FIG. 1 shows the sectional box that is formed of six regular square-shaped sheets 1, FIG. 2 shows the pyramid-shaped sectional box that is formed of one regular square-shaped sheet 1 and four regular triangle-shaped sheets 2, and FIG. 5 shows the sectional lighting case that is formed of three regular square-shaped sheets 1, one regular triangle-shaped sheet 2 and another regular triangle-shaped sheet 2'.

FIG. 14 shows a packaging box that is employed with the multipurpose fancy goods of this invention, and FIGS. 11 and 12 show the assembling process for the multipurpose fancy goods of this invention.

FIGS. 15 to 18 illustrate the photographs of the various kinds of multipurpose fancy goods of this invention.

Referring to the assembling process for the multipurpose fancy goods of this invention, in more detail, the regular square-shaped sheet coupling parts 11 are folded vertically along the dotted lines on each edge of the regular square-shaped sheet 1, and they are inserted into the regular square-shaped sheet coupling through holes 10 that are formed around each corner of the regular square-shaped sheet 1, as shown in FIG. 12. In case of coupling the regular triangle-shaped sheets 2, as shown in FIG. 11, the regular triangle-shaped sheet coupling parts 20 are folded vertically along the dotted lines on each edge of the regular triangle-shaped sheet 1, and they are inserted into the regular triangle-shaped sheet coupling through holes 20 that are formed around each corner thereof.

This coupling process will be in more detail described with reference to FIG. 6. In this embodiment, three regular square-shaped sheets 1, one regular triangle-shaped sheet 2 and one regular triangle-shaped sheet 2' are needed.

The lighting 25 is first inserted into the regular triangle-shaped sheet central through hole 22 of the regular triangle-shaped sheet 2' as viewed on the right side in the drawing by the use of the socket 23 to which an electric wire is connected and the fixing member 24, and after that, the head part 61 of the regular triangle-shaped sheet coupling part 34' at one side of the lower edge of the regular triangle-shaped sheet 2' is inserted into the regular square-shaped sheet coupling through hole 51 on one side of the right front portion of the regular square-shaped sheet 1-2 on the bottom surface of the lighting box of this invention. In this manner, the head part 61 of the regular triangle-shaped sheet coupling part 35' at one side of the left edge of the regular triangle-shaped sheet 2' is inserted into the regular square-shaped sheet coupling through hole 41 on one side of the right upper portion of the regular square-shaped sheet 1-1 formed obliquely on the left side of the lighting box, and the head part 61 of the regular triangle-shaped sheet coupling part 36' at one side of the right edge of the regular triangle-shaped sheet 2' is inserted into the regular square-shaped sheet coupling through hole 43' on one side of the right lower portion of the regular square-shaped sheet 1-3 formed obliquely on the right side of the lighting box of this invention.

The regular square-shaped sheet coupling part 46 at one side of the right edge of the regular square-shaped sheet 1-1 is inserted into the regular triangle-shaped sheet coupling through hole 31 on one side of the left lower portion of the regular triangle-shaped sheet 2', and the regular square-shaped sheet coupling part 45 at one side of the upper edge of the regular square-shaped sheet 1-1 is inserted into the regular square-shaped sheet coupling through hole 44' on one side of the right upper portion of the regular square-shaped sheet 1-3.

The regular square-shaped sheet coupling part 48 at one side of the left edge of the regular square-shaped sheet 1-1 is inserted into the regular triangle-shaped sheet coupling through hole 32 on one side of the upper portion of the regular triangle-shaped sheet 2 as viewed on the left side in the drawing, and the regular square-shaped sheet coupling part 47 at one side of the lower edge of the regular square-shaped sheet 1-1 is inserted into the regular square-shaped sheet coupling through hole 52 on one side of the left front portion of the regular square-shaped sheet 1-2.

The head part 61 of the regular triangle-shaped sheet coupling part 34 at one side of the lower edge of the regular triangle-shaped sheet 2 is inserted into the regular square-shaped sheet coupling through hole 53 on one side of the left rear portion of the regular square-shaped sheet 1-2, and the head part 61 of the regular triangle-shaped sheet coupling part 35 at one side of the right edge of the regular triangle-shaped sheet 2 is inserted into the regular square-shaped sheet coupling through hole 41' on one side of the left upper portion of the regular square-shaped sheet 1-3. The head part 61 of the regular triangle-shaped sheet coupling part 36 at one side of the left edge of the regular triangle-shaped sheet 2 is inserted into the regular square-shaped sheet coupling through hole 43 on one side of the right lower portion of the regular square-shaped sheet 1-1.

The regular square-shaped sheet coupling part 56 at one side of the front edge of the regular square-shaped sheet 1-2 is inserted into the regular square-shaped sheet coupling through hole 42 on one side of the right lower portion of the regular square-shaped sheet 1-1, and the regular square-shaped sheet coupling part 55 at one side of the right edge of the regular square-shaped sheet 1-2 is inserted into the regular triangle-shaped sheet coupling through hole 33' on one side of the right lower portion of the regular triangle-shaped sheet 2'. The regular square-shaped sheet coupling part 58 at one side of the rear edge of the regular square-shaped sheet 1-2 is inserted into the regular square-shaped sheet coupling through hole 42' on one side of the left lower portion of the regular square-shaped sheet 1-3, and the regular square-shaped sheet coupling part 57 at one side of the left edge of the regular square-shaped sheet 1-2 is inserted into the regular triangle-shaped sheet coupling through hole 33 on one side of the left lower portion of the regular triangle-shaped sheet 2.

The regular square-shaped sheet coupling part 46' at one side of the left edge of the regular square-shaped sheet 1-3 is inserted into the regular triangle-shaped sheet coupling through hole 31 on one side of the right lower portion of the regular triangle-shaped sheet 2, and the regular square-shaped sheet coupling part 45' at one side of the lower edge of the regular square-shaped sheet 1-3 is inserted into the regular square-shaped sheet coupling through hole 44 on one side of the left upper portion of the regular square-shaped sheet 1-1. The regular square-shaped sheet coupling part 48' at one side of the right edge of the regular square-shaped sheet 1-3 is inserted into the regular triangle-shaped sheet coupling through hole 32' on one side of the upper portion of the regular triangle-shaped sheet 2', and the regular square-shaped sheet coupling part 47' at one side of the lower edge of the regular square-shaped sheet 1-3 is inserted into the regular square-shaped sheet coupling through hole 54 on one side of the left front portion of the regular square-shaped sheet 1-2.

The disassembling process is carried out in the reverse order to the above-mentioned assembling process.

After assembling, things to be packaged are placed into the packaging box as an example of the multipurpose fancy goods of this invention, as shown in FIG. 1.

As clearly discussed above, the multipurpose fancy goods of this invention are embodied as sectional fancy boxes, lighting cases for decoration, or puzzles, which all have excellent appearances. In case of the sectional boxes, especially, they can be piled up after keeping the things in them and when it is necessary to move to another place, they can be disassembled with ease, thereby ensuring a high efficiency in use.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. Multipurpose fancy goods having a plurality of sheets connected to each other to form a polyhedron, the multipurpose fancy goods comprising:

a first regular square-shaped sheet, a second regular square-shaped sheet, a first regular triangle-shaped sheet, and a second regular triangle-shaped sheet each being made of a polypropylene foam sheet, wherein each of the first and second regular square-shaped sheets has four regular square-shaped sheet coupling parts each protruded outwardly from one side of each edge thereof in such a manner as not to be adjacent to the next one, and each of the first and second regular triangle-shaped sheets has three regular triangle-shaped sheet coupling parts each protruded outwardly from one side of each edge thereof in such a manner as not to be adjacent to the next one, and wherein each of the first and second regular square-shaped sheets has four regular square-shaped sheet coupling through holes each formed around each corner thereof, and each of the first and second regular triangle-shaped sheets has three regular triangle-shaped sheet coupling through holes each formed around each corner thereof, such that the respective four regular square-shaped sheet coupling parts of the first and second regular square-shaped sheets are inserted into four regular square-shaped sheet coupling holes for other regular square-shaped sheets adjacent to the upper and lower sides and the left and right sides thereof, and the respective three regular triangle-shaped sheet coupling parts of the first and second regular triangle-shaped sheet are inserted into three regular triangle-shaped sheets coupling holes for other regular triangle-shaped sheets adjacent to the upper and lower sides and the left and right sides thereof, wherein the second regular square-shaped sheet comprises four regular square-shaped sheet coupling parts each protruded outwardly from one side of each edge thereof, four regular square-shaped sheet coupling through holes each formed around each corner thereof, a regular square-shaped sheet central through hole formed in the middle thereof, a socket and a fixing member adapted to the inserted into the regular square-shaped sheet central through hole, and an lighting adapted to be inserted fixedly into the socket and the fixing member, and the second regular triangle-shaped sheet comprises three regular triangle-shaped sheet coupling parts each protruded outwardly from one side of each edge thereof, three regular triangle-shaped sheet coupling through holes each formed around each corner thereof, a regular triangle-shaped sheet central through hole formed in the middle thereof, a socket and a fixing member adapted to be inserted into the regular triangle-shaped sheet central through hole, and an lighting adapted to be inserted fixedly into the socket and the fixing member.

2. The multipurpose fancy goods as defined in claim 1, wherein the four regular square-shaped sheet coupling parts and the three regular triangle-shaped sheet coupling parts each have a head part with a top portion protruded in a round shape, head side parts protruded outwardly in a relatively larger oval than a circle at both sides of the head part, a neck part somewhat indented to the both sides of the head part, and a coupling body part formed in an oval being extended to the left and right at the lower portion of the neck part.

* * * * *